US005447287A

United States Patent [19]

Kelly et al.

[11] Patent Number: 5,447,287

[45] Date of Patent: Sep. 5, 1995

[54] FUEL CONTROL DEVICE AND METHODS OF MAKING THE SAME

[75] Inventors: Samuel T. Kelly, Torrance; Robert G. Dewey, Jr., Whittier, both of Calif.

[73] Assignee: Robertshaw Controls Company, Richmond, Va.

[21] Appl. No.: 267,111

[22] Filed: Jun. 24, 1994

[51] Int. Cl.[6] ..... F16K 31/06; F16K 31/11

[52] U.S. Cl. ..... 251/129.03; 251/129.19; 251/258

[58] Field of Search ..... 251/129.02, 129.03, 251/129.19, 258

[56] References Cited

U.S. PATENT DOCUMENTS

| | | | |
|---|---|---|---|
| 2,389,387 | 11/1945 | Rutherford et al. | 251/129.03 X |
| 2,630,139 | 3/1953 | Nagel | 251/129.02 |
| 3,084,676 | 4/1963 | Herion et al. | 251/129.03 X |
| 4,534,381 | 8/1985 | Hozumi et al. | 251/129.03 X |
| 4,921,011 | 5/1990 | Kelly et al. | 137/595 |
| 5,145,146 | 9/1992 | Matsushima | 251/129.19 X |

FOREIGN PATENT DOCUMENTS

| | | | |
|---|---|---|---|
| 483940 | 6/1952 | Canada | 251/129.19 |

*Primary Examiner*—Stephen M. Hepperle
*Attorney, Agent, or Firm*—Candor, Candor & Tassone

[57] ABSTRACT

A fuel control device and method of making the same are provided, the fuel control device comprising a housing having an inlet separated from an outlet by a valve seat and having a movable valve member for opening and closing the valve seat, an electrical coil, a movable armature being moved to a first position thereof when the coil is energized and being moved to a second position thereof when the coil is deenergized, and a tension spring operatively interconnecting the valve member to the armature.

8 Claims, 8 Drawing Sheets

FUEL CONTROL DEVICE AND METHODS OF MAKING THE SAME

BACKGROUND OF THE INVENTION

1. Field of the Invention

This invention relates to a new fuel control device and to a new method of making such a fuel control device.

2. Prior Art Statement

It is known to provide a fuel control device comprising a housing means having an inlet separated from an outlet by a valve seat, a movable valve member carried by the housing means for opening and closing the valve seat, an electrical coil carried by the housing means, a movable armature carried by the housing means and being movable to a first position thereof by the coil being energized and being movable to a second position thereof when the coil means is deenergized, and means operatively interconnecting the valve member to the armature so that the valve member tends to move to an open position thereof relative to the valve seat when the armature is moved to the first position thereof and tends to move to a closed position thereof with the valve seat when the armature is moved to the second position thereof. For example, see the U.S. Pat. No. 4,921,011 to Kelly et al.

It is also known to provide a fuel control device comprising a housing means having a pair of valve seats therein and a pair of movable valve members for respectively opening and closing the valve seats, a casing mounted to the housing means and comprising a supporting means, the supporting means comprising a pair of flux plates disposed in spaced apart relation, an electrical coil disposed in the casing between the flux plates, two movable plunger means respectively having portions thereof disposed in the casing in generally a side-by-side spaced apart relation and being operatively associated with the coil and the flux plates to be moved to certain positions thereof when the coil is energized, and means operatively interconnecting the plunger means respectively to the valve members so that the valve members are moved to open positions thereof relative to the valve seats when the coil is energized. For example, see the aforementioned U.S. Pat. No. 4,921,011 to Kelly et al.

It is also known to provide a fuel control device comprising a housing means having a first valve seat separating a first inlet from a first outlet and having a second valve seat separating a second inlet from a second outlet, a first movable valve member carried by the housing means for opening and closing the first valve seat, and a second movable valve member carried by the housing means for opening and closing the second valve seat. For example, see the aforementioned U.S. Pat. No. 4,921,011 to Kelly et al.

It is also known to applicants to provide a one-piece homogeneous flexible diaphragm having a first portion for operating a first valve means and a second portion for operating a second valve means.

SUMMARY OF THE INVENTION

It is one of the features of this invention to provide a new fuel control device wherein a valve member that is operatively interconnected to an armature of a coil means can be carried by the coil means and still be held in a certain position thereof even if the coil is energized and moves the armature to another position thereof.

In particular, it was found according to the teachings of this invention that a tension spring can be utilized to interconnect the valve member to the armature for such purpose.

For example, one embodiment of this invention comprises a fuel control device comprising a housing means having an inlet separated from an outlet by a valve seat, a movable valve member carried by the housing means for opening and closing the valve seat, an electrical coil carried by the housing means, a movable armature carried by the housing means and being movable to a first position thereof by the coil being energized and being movable to a second position thereof when the coil is deenergized, and means operatively interconnecting the valve member to the armature so that the valve member tends to move to an open position thereof relative to the valve seat when the armature is moved to the first position thereof and tends to move to a closed position thereof with the valve seat when the armature is moved to the second position thereof, the means operatively interconnecting the valve member to the armature comprising a tension spring.

It is another feature of this invention to provide a new fuel control device wherein one of the flux plates of a coil arrangement for operating two valve members is utilized to fasten the coil arrangement to a housing means that has two valve seats therein that are respectively controlled by the two valve members.

For example, another embodiment of this invention comprises a fuel control device comprising a housing means having a pair of valve seats therein and a pair of movable valve members for respectively opening and closing the valve seats, a casing mounted to the housing means and comprising a supporting means, the supporting means comprising a pair of flux plates disposed in spaced apart relation, an electrical coil disposed in the casing between the flux plates, two movable plunger means respectively having portions thereof disposed in the casing in generally a side-by-side spaced apart relation and being operatively associated with the coil and the flux plates to be moved to certain positions thereof when the coil is energized, and means operatively interconnecting the plunger means respectively with the valve members so that the valve members are moved to open positions thereof relative to the valve seats when the coil is energized, the casing comprising a cup-shaped member having an open end facing the housing means, one of the flux plates closing the open end of the cup-shaped member and being fastened against the housing means to mount the casing to the housing means.

It is another feature of this invention to provide a new fuel control device that has unique valve seat structure for a pair of movable valve members thereof.

In particular, it was found according to the teachings of this invention that a substantially flat plate can form part of the housing means of the control device and have two opening means passing therethrough in spaced apart relation to respectively define the two valve seats.

For example, another embodiment of this invention comprises a fuel control device comprising a housing means having a first valve seat separating a first inlet from a first outlet and having a second valve seat separating a second inlet from a second outlet, a first movable valve member carried by the housing means for opening and closing the first valve seat, and a second movable valve member carried by the housing means for opening and closing the second valve seat, the housing means comprising a substantially flat plate having opposed substantially flat parallel sides and having two openings passing therethrough in spaced apart relation and respectively defining the first valve seat and the second valve seat.

Accordingly, it is an object of this invention to provide a new fuel control device having one or more of the novel features of this invention as set forth above or hereinafter shown or described.

Another object of this invention is to provide a new method of making such a fuel control device, the method of this invention having one or more of the novel features of this invention as set forth above or hereinafter shown or described.

Other objects, uses and advantages of this invention are apparent from a reading of this description which proceeds with reference to the accompanying drawings forming a part thereof and wherein:

DESCRIPTION OF THE PREFERRED EMBODIMENTS

Figure 1:
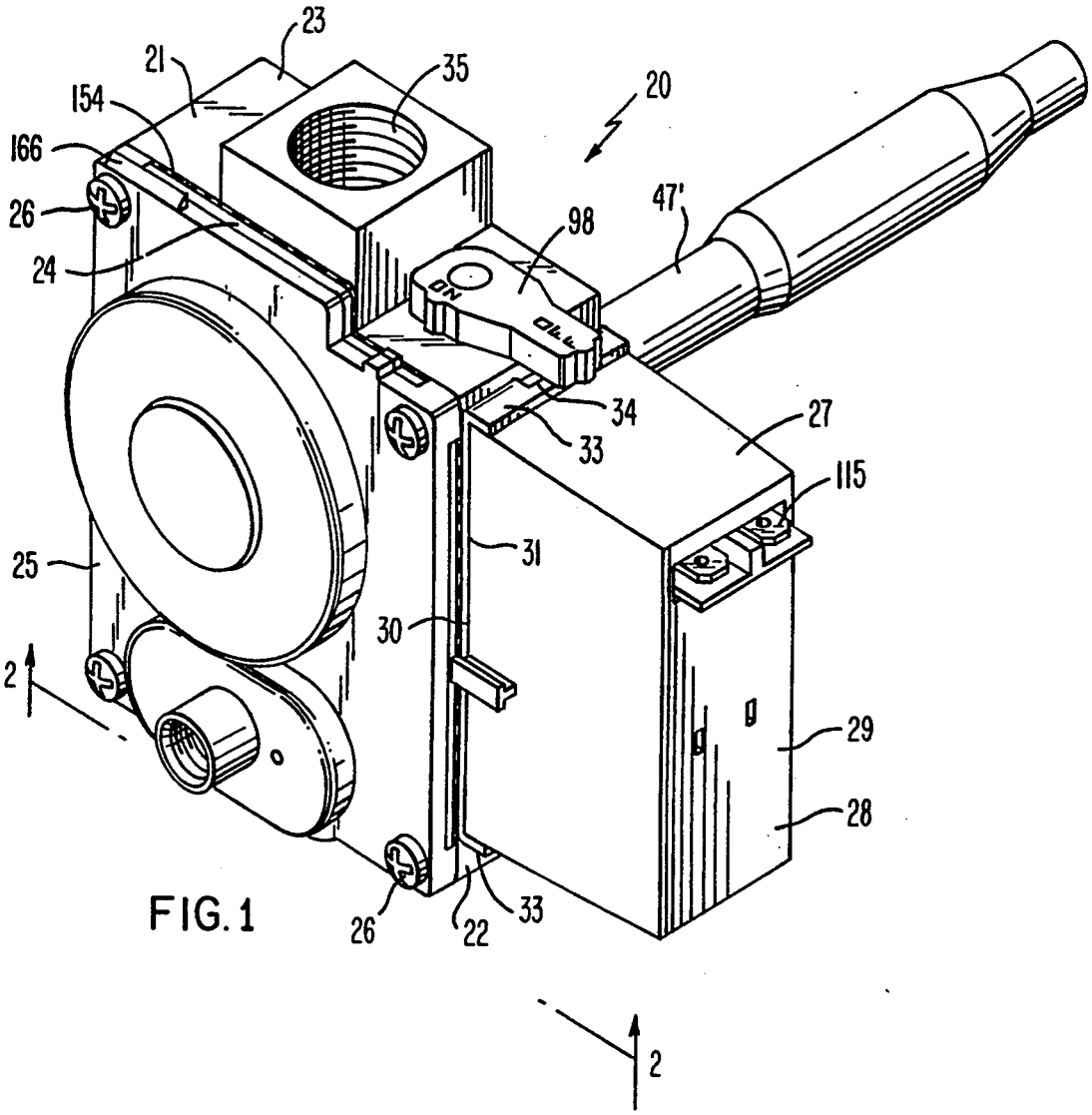
FIG. 1 is a perspective view of the new fuel control device of this invention.

While the various features of this invention are hereinafter illustrated and described as being particularly adapted to provide a fuel control device having a particular configuration, it is to be understood that the various features of this invention can be utilized singly or in various combinations thereof to provide a fuel control device having other configurations as desired.

Therefore, this invention is not to be limited to only the embodiments illustrated in the drawings, because the drawings are merely utilized to illustrate one of the wide variety of uses of this invention.

Figure 2:
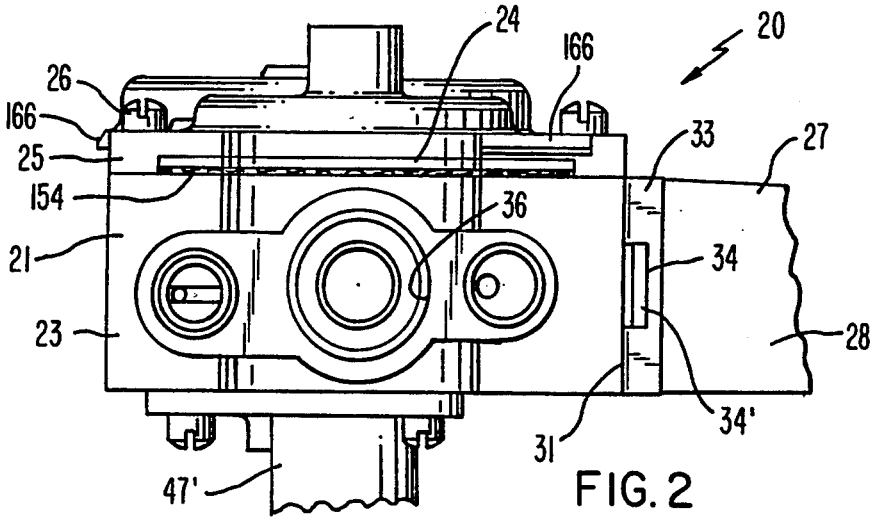
FIG. 2 is a fragmentary end view of the fuel control device of FIG. 1 and is taken in the direction of the arrows 2—2 of FIG. 1.
Figure 12:
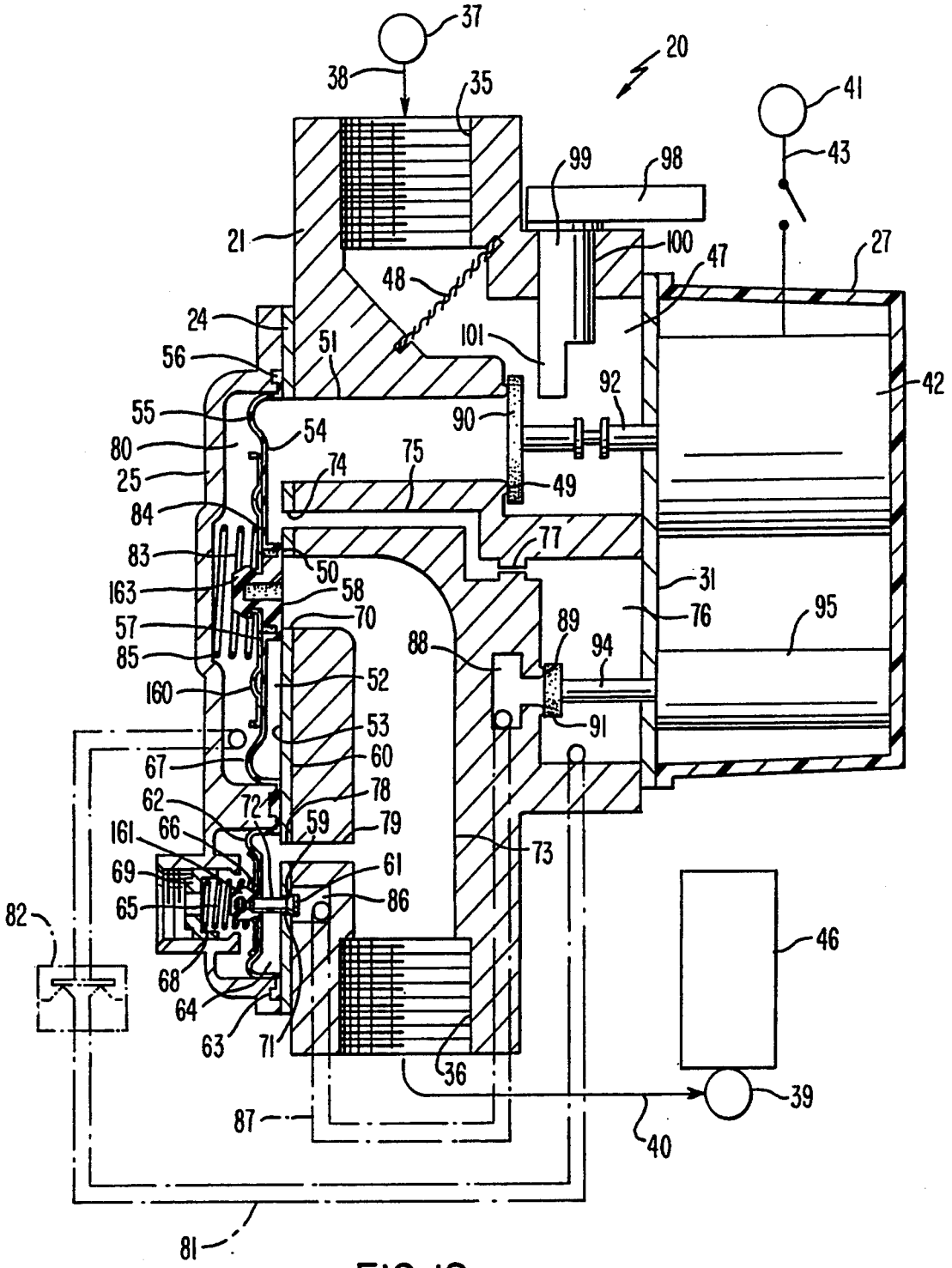
FIG. 12 is a schematic view illustrating the fuel control device of this invention being utilized in a fuel control system.

Referring now to FIGS. 1, 2 and 12, the new fuel control device of this invention is generally indicated by the reference numeral 20 and comprises a housing means 21 formed of any suitable material, such as metallic material, and having exterior wall means 22, the housing means 21 comprising a main housing body 23, a valve plate 24 and an outer plate or member 25 disposed in stacked relation and being secured together by fastening means 26.

Figure 11:
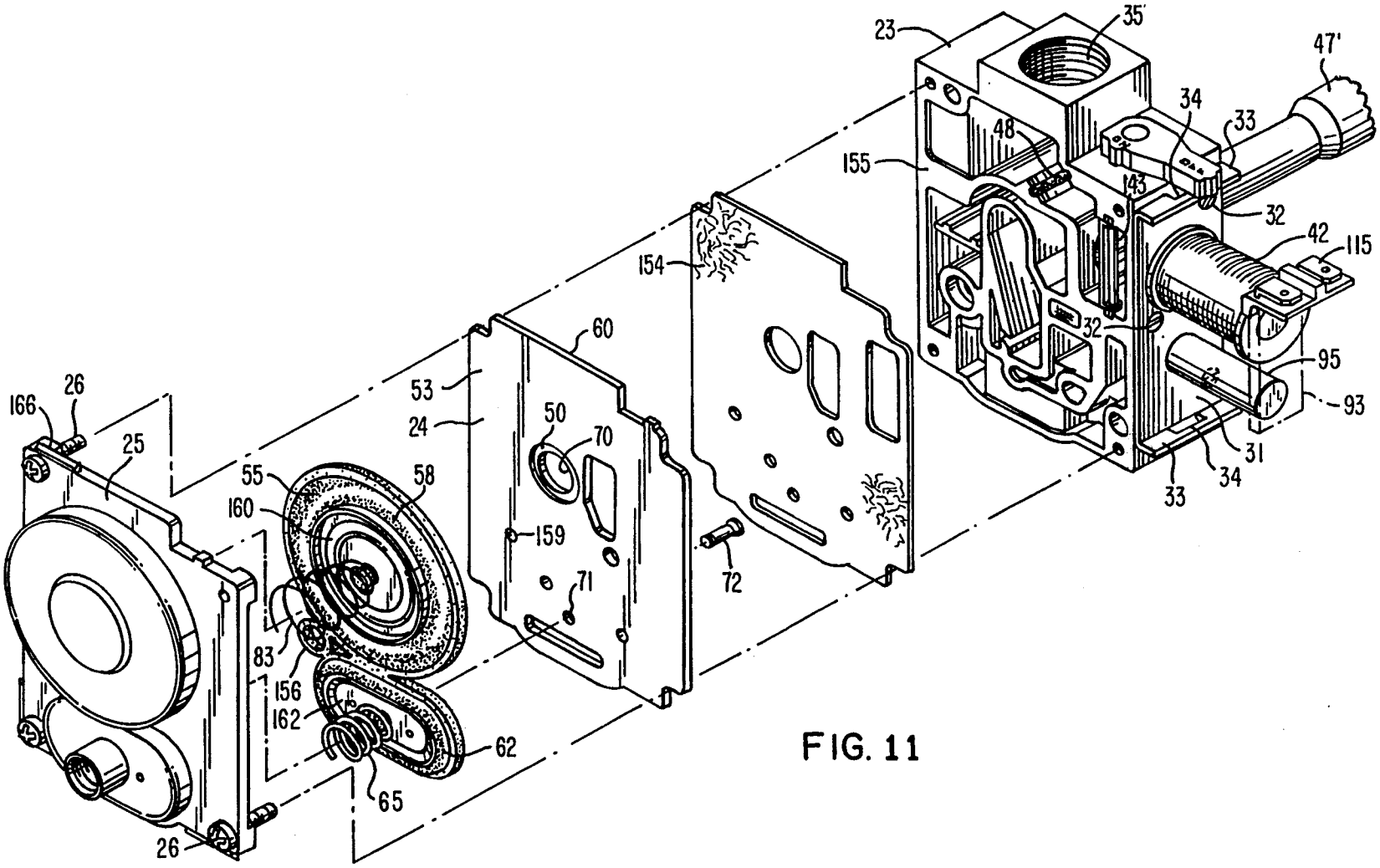
FIG. 11 is an exploded perspective view of certain parts of the fuel control device of this invention.

A casing 27 is secured to the exterior wall means 22 of the housing body member 23 of the housing means 21 and comprises a cup-shaped member 28 formed of any suitable material, such as electrically insulating polymeric material and having a closed end 29 and an open end 30 that is uniquely closed by a metallic flux plate 31 of this invention that is fastened to the body part 23 of the housing means 21 by threaded fastening members 32 as illustrated in FIG. 11.

Figure 3:
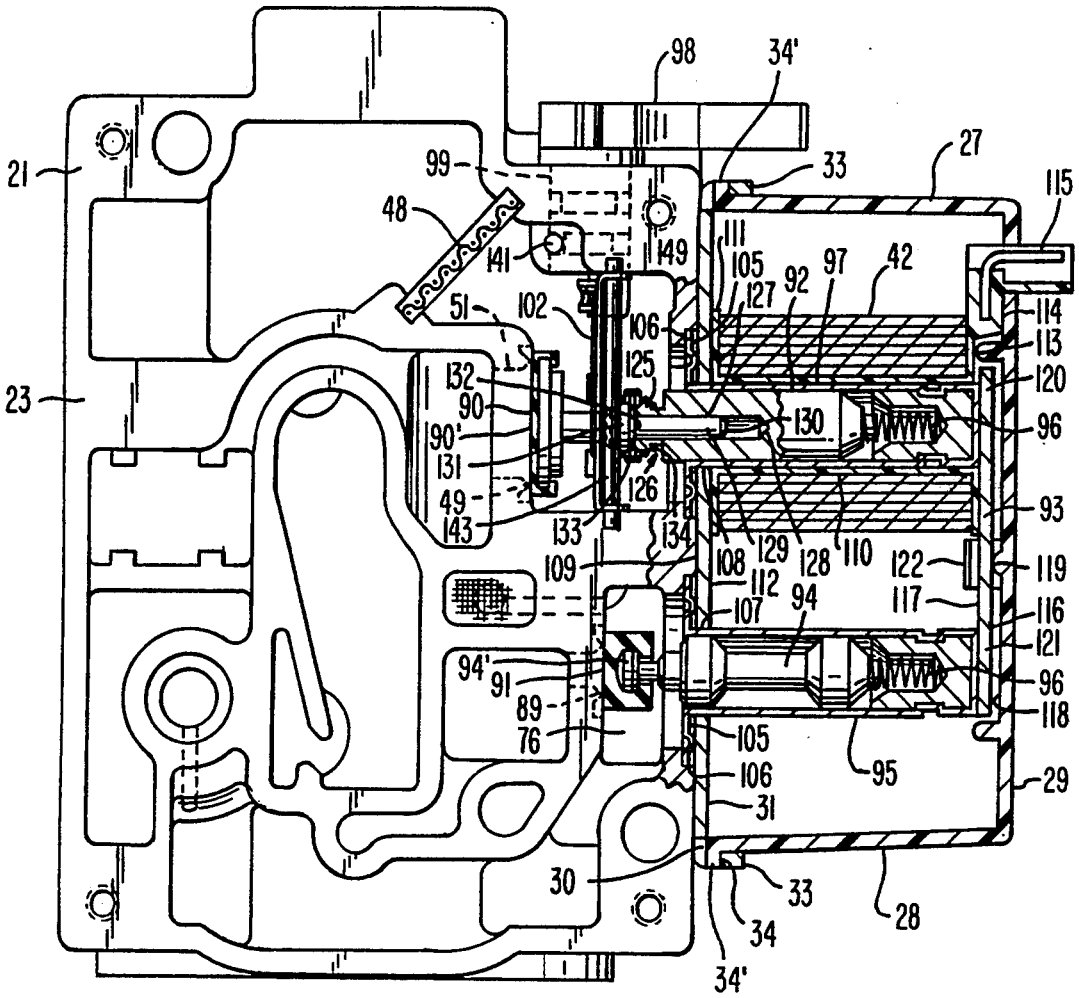
FIG. 3 is an enlarged view of the control device of FIG. 1 with part of the housing means thereof removed and with the electrical coil arrangement thereof shown in cross section with the valve members controlled thereby being disposed in their closed positions.

As illustrated in FIG. 3 and FIG. 11, the flux plate 31 is substantially flat and has opposed turned ends 33 respectively disposed parallel to each other and substantially perpendicular to the remainder of the flux plate 31. The turned ends 33 respectively have slots 34 formed therethrough and snap-fittingly receiving outwardly extending flanges 34' therein that are formed on the casing 27 adjacent the open end 30 thereof and having been snap-fitted through the slots 34 of the turned ends 33 of the flux plate 31 to fasten the casing 27 to the flux plate 31 and thereby close the open end 30 thereof.

Figure 8:
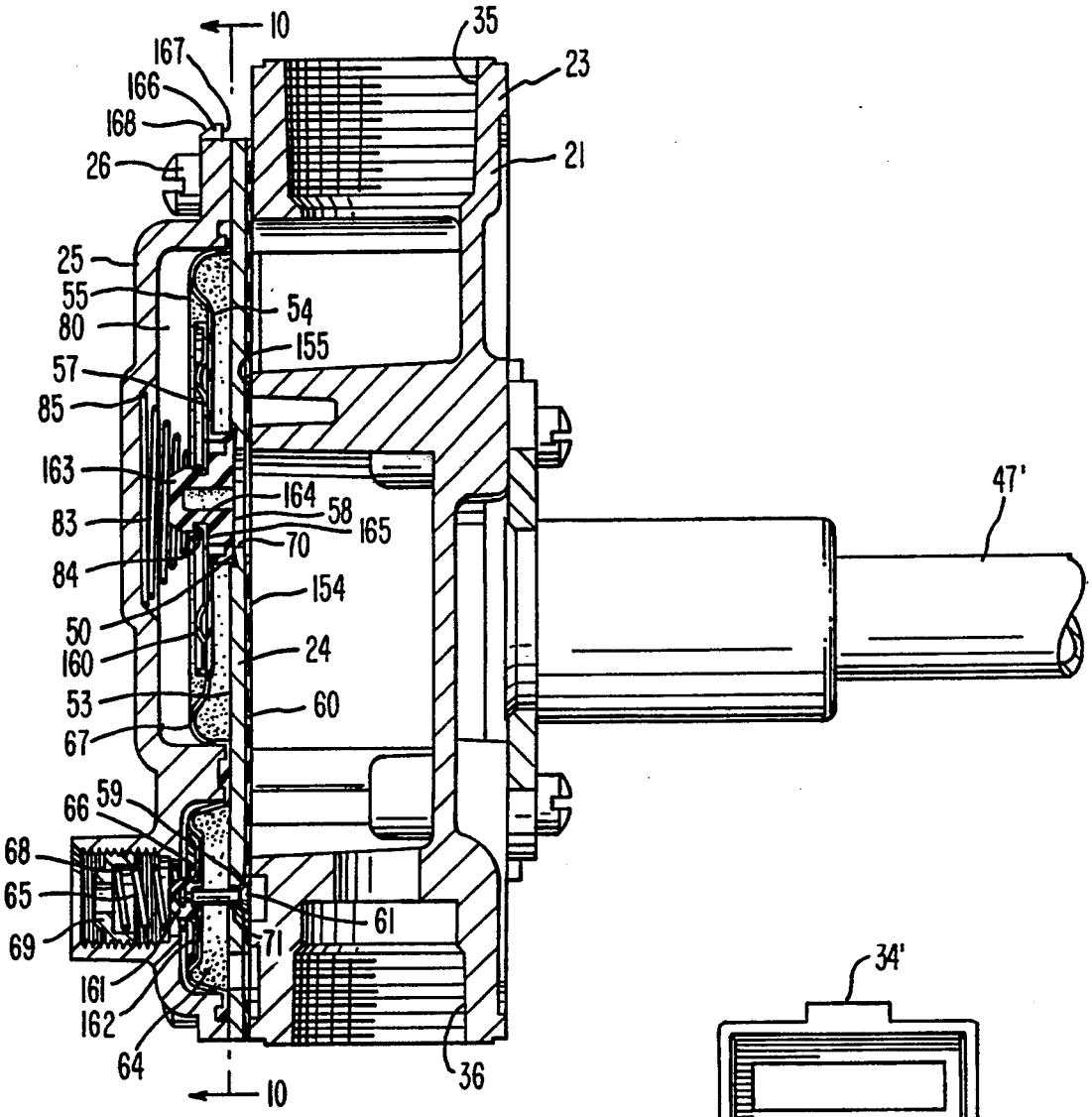
FIG. 8 is a cross-sectional view taken on line 8—8 of FIG. 5.

As illustrated in FIGS. 8 and 12, the housing body 23 of the housing means 21 has an inlet means 35 formed therein and an outlet means 36 also formed therein, the inlet means and the outlet means 36 being respectively internally threaded so as to be adapted to be coupled to suitably externally threaded ends of conduit means in a manner well known in the art so that a source of fuel 37 can be interconnected to the inlet 35 as represented by the arrow 38 in FIG. 12 and a suitable burner means 39 can be interconnected to the outlet 36 as represented by the arrow 40 in FIG. 12.

The fuel control device 20 of this invention is adapted to interconnect the inlet 35 with the outlet 36 in order to provide a flow of fuel to the burner means 39 for any desired purpose, such as for heating water contained in a tank of a water heater. Of course, the fuel control device 20 of this invention could supply fuel to a furnace or other apparatus as desired.

In any event, the fuel control device 20 of this invention is adapted to be electrically operated in a manner hereinafter described wherein an electrical power source 41, FIG. 12, is adapted to be interconnected to an-electrical coil 42 of the fuel control device 20 by electrical circuit means 43 to cause the fuel control device 20 to interconnect the inlet 35 to the outlet 36 in a manner hereinafter set forth so that fuel can issue from the burner means 39 and be ignited in any suitable manner, such as under the control of the circuit means 43 in a manner well known in the art. For example, see the fuel control device and the electrical system thereof that are set forth in the aforementioned U. S. Pat. No. 4,921,011, to Kelly et al, whereby this U.S. patent is being incorporated into this disclosure by this reference thereto.

Figure 13:
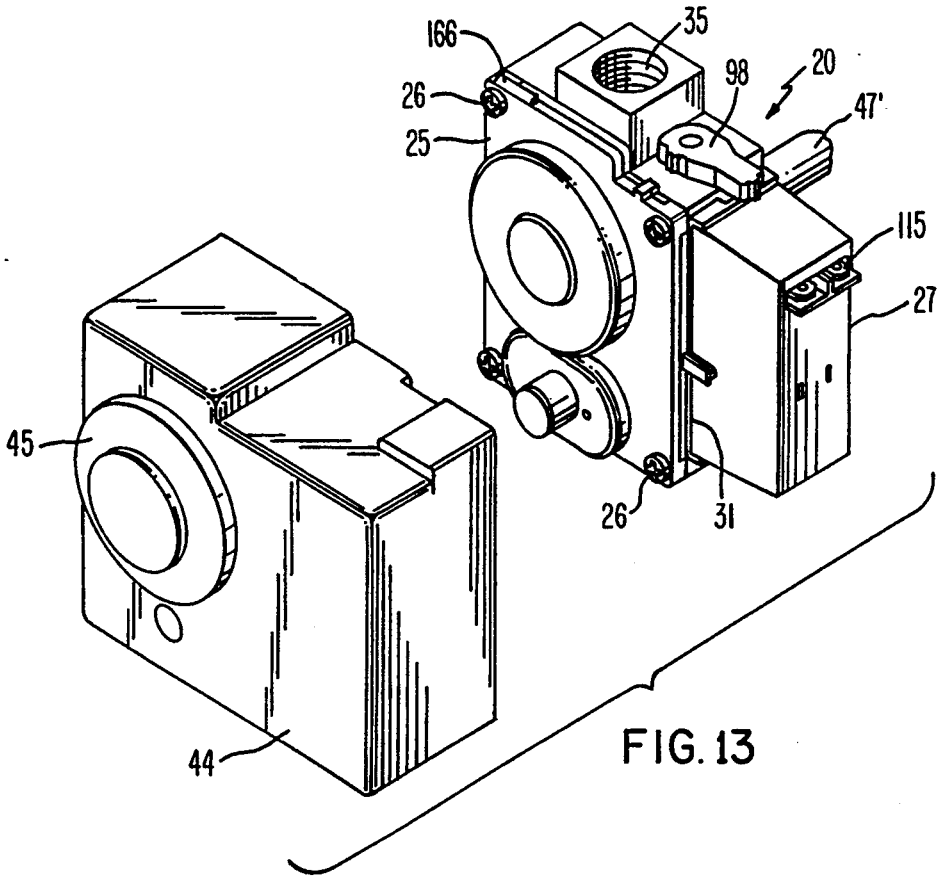
FIG. 13 is an exploded perspective view illustrating how a housing means that contains an electronic control system can be mounted to the housing means of the fuel control device of FIGS. 1–12.
Figure 14:
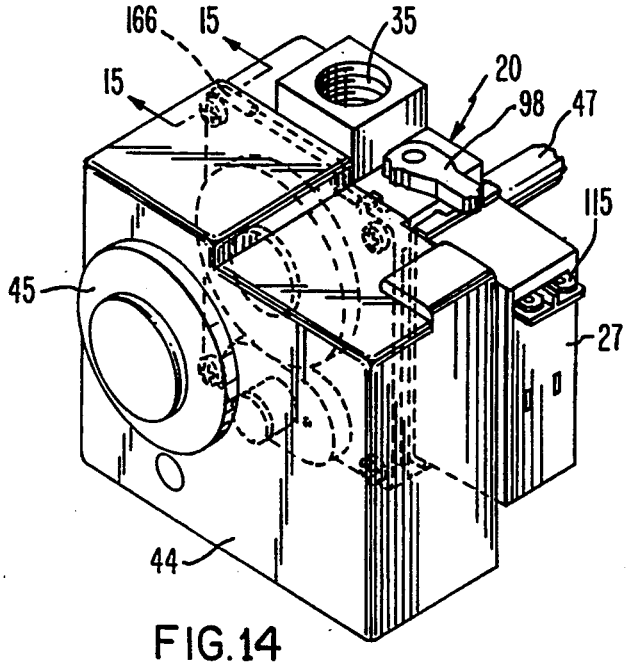
FIG. 14 is a perspective view illustrating the housing means of the electronic control system secured to the housing means of the fuel control device of FIGS. 1–12.

The electrical circuit means 43 and its associated electronic components etc. (not shown) can be carried in a separate housing means 44, FIGS. 13–15, that can be fastened to the housing means 21 in a manner hereinafter set forth so as to be carried by the housing means 21 in a self-contained manner therewith, the housing means 44 including a temperature setting knob means 45 wherein an operator can set the knob 45 at a desired temperature setting whereby the fuel control device 20 will tend to maintain the water in the tank of the water heater that is schematically illustrated in FIG. 12 and indicated by the reference numeral 46 at the selected temperature.

The fuel control device 20 of this invention has the housing means 21 thereof carrying a tube means 47' that is adapted to be disposed in the water in the tank of the water heater 46 in a manner conventional in the art and contains a thermistor therein which senses the temperature of the water and through the electrical circuit means 43 determines when the electrical coil 42 is to be energized to supply fuel to the burner means 39 and when the electrical current through the coil means 42 is to be deenergized so as to prevent fuel from being directed to the burner means 39 and thereby tend to maintain the temperature of the water at the temperature selected by the setting of the rotatable selector means 45 on the housing means 44.

Such general operation of an electrical system for controlling the flow of fuel to a burner means by the use of a thermistor is well known in the art. For example, see the U.S. Pat. No. 4,641,778 to Dodson, whereby this U.S. patent is also being incorporated into this disclosure by this reference thereto.

Also, since the details of an electronic control system contained within the housing means 44 for the fuel control device 20 of this invention does not form a part of this invention, a further discussion thereof is deemed unnecessary. However, the copending patent application of Kurt T. Williams, Ser. No. 194,244, filed Feb. 10, 1994, discloses one type of electronic control system that can be utilized with the fuel control device 20 of this invention.

The general features of the fuel control device 20 of this invention are schematically illustrated in FIG. 12 and will now be described.

The housing means 21 of the fuel control device 20 has suitable passages and chambers formed therein and it can be seen in FIG. 12 that the inlet 35 is interconnected to a chamber 47, the housing means 21 carrying an inlet screen or filter 48 between the inlet 45 and the chamber 47 as conventional in the art. A valve seat 49 in the housing means 21 is adapted to interconnect the chamber 47 to another valve seat 50 thereof by means of a passage means 51 formed in the housing means 21 and leading to a chamber 52 formed between a flat side 53 of the valve plate 24 and a side 54 of a flexible diaphragm means 55 that has an outer peripheral portion 56 of a first diaphragm section 57 thereof sandwiched between the housing member 25 and the side 53 of the valve plate 24.

The diaphragm section 57 of the flexible diaphragm means 55 carries a valve member 58 that controls the opening and closing of the valve seat 50 of the valve plate 24 in a manner hereinafter set forth.

The valve seat 50 is formed on the flat side 53 of the valve plate 24 while another valve seat 59 is formed on the other flat side 60 of the valve plate 24 and is controlled by a valve member 61 carried by another diaphragm section 62 of the diaphragm means 55 which has an outer peripheral portion 63 thereof sandwiched between the housing member 25 and the side 53 of the valve plate 24 so as to cooperate with the side 53 of the valve plate 24 to define a chamber 64 between the side 54 of the diaphragm section 62 and the side 53 of the valve plate 24.

The diaphragm section 62 is urged in a direction to open the valve member 61 away from the valve seat 59 by a compression spring 65 having one end 66, in effect, bearing against a side 67 of the diaphragm means 55 and the other end 68 thereof bearing against an adjustable spring retainer 69 carried by the housing member 25 as illustrated in FIG. 12 and in a manner well known in the art.

The valve seats 50 and 59 of the valve plate 24 are respectively defined in part by openings 70 and 71 passing through the valve plate 24 in the spaced apart relation as illustrated, the valve member 61 having a stem 72 passing through the opening 71 and being interconnected to the diaphragm section 62 so as to be carried thereby. In contrast, the valve member 58 comprises a part that is integral and one-piece with the diaphragm section 57 but could be formed separately and then be secured thereto, if desired.

The opening 70 through the valve plate 24 is adapted to interconnect the valve seat 50 to a passage means 73 formed in the housing means 21 and leading to the outlet 36.

Another opening 74 is formed through the valve plate 24 and continuously interconnects the passage 51 to another passage 75 in the housing means 21 that leads to another chamber 76 formed therein, the passage 75 having an orifice means 77 disposed therein for a purpose hereinafter set forth.

The valve plate 24 has another opening 78 passing therethrough and continuously interconnecting the chamber 64 of the diaphragm section 62 to a passage 79 of the housing means 21 that leads to the passage 73 and, thus, to the outlet 36.

The side 67 of the diaphragm section 57 cooperates with the housing member 25 to define a chamber 80 therebetween, the chamber 80 being interconnected to the chamber 76 by a passage means 81 formed in the housing means 21 and having a slow opener means therein that is generally indicated by the reference numeral 82 for initially causing the valve member 58 to slowly open relative to the valve seat 50 on the initial opening of the valve seat 50 each time the valve member 58 is to open away from the valve seat 50 in a manner conventional in the art. For example, see the U.S. patent to Kelly, U.S. Pat. No. 4,643,391 whereby this U.S. patent is being incorporated into this disclosure by this reference thereto.

A compression spring 83 is disposed in the diaphragm chamber 80 and has one end 84, in effect, bearing against the side 67 of the diaphragm section 57 and the other end 85 thereof bearing against the housing member 25 so as to tend to maintain the valve member 58 in its closed condition against the valve seat 50.

The valve seat 59 of the valve plate 24 is adapted to be interconnected to a chamber 86 in the housing means 21 that is interconnected by a passage means 87 of the housing means 21 to another chamber 88 thereof, the chamber 88 being interconnected to the chamber 76 by a valve seat 89 of the housing means 21 for a purpose hereinafter set forth.

The valve seats 49 and 89 of the housing means 21 are respectively controlled by valve members 90 and 91 which, in turn, are controlled by the coil 42.

In particular, when the coil 42 is energized by the circuit means 43 interconnecting the electrical power source 41 thereto, not only is an armature or plunger 92 that is interconnected to the valve member 90 in a manner hereinafter set forth drawn upwardly in FIG. 12 into the energized coil 42 so as to open the valve member 90 away from the valve seat 49, but also the flux being created by the energized coil 42 and the flux plate 31, as well as another flux plate 93, FIG. 3, carried by the casing 27 in a manner hereinafter described, operates on an armature or plunger 94 that is interconnected to the valve member 91 to pull the same upwardly in FIG. 12 into a pole piece 95 that is external to the coil 42 all for the reasons fully set forth in the aforementioned U.S. Pat. No. 4,921,011 to Kelly et al.

However, when the circuit means 43 disconnects the electrical power source 41 from the coil 42 so as to deenergize the same, compression spring means 96 disposed in the pole pieces 95 and 97 respectively for the plungers or armatures 94 and 92 for the respective valve members 91 and 90, in effect, urge the valve members 91 and 90 respectively against their valve seats 89 and 49 to close the same.

Figure 4:
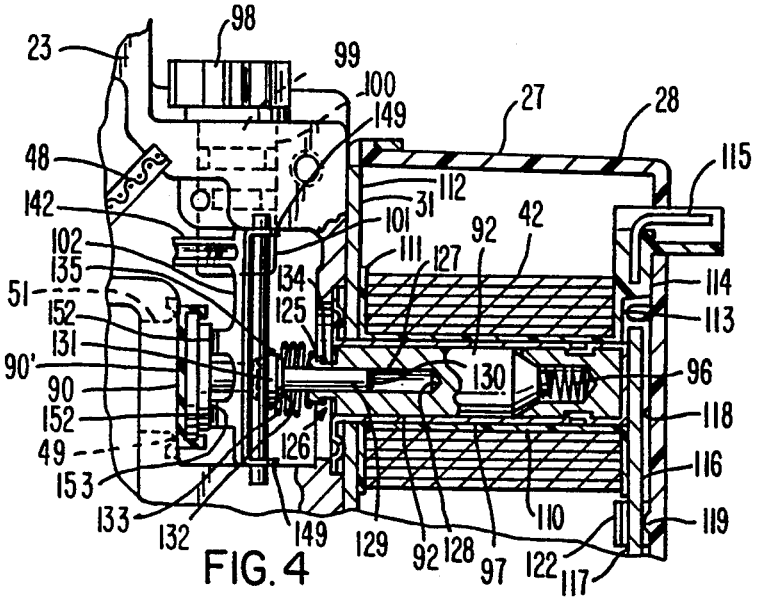
FIG. 4 is a fragmentary view similar to FIG. 3 and illustrates the manually operated actuator of the fuel control device holding its associated valve member in its closed position even though the electrical coil is energized and is tending to move that valve member to an open position thereof.
Figure 5:
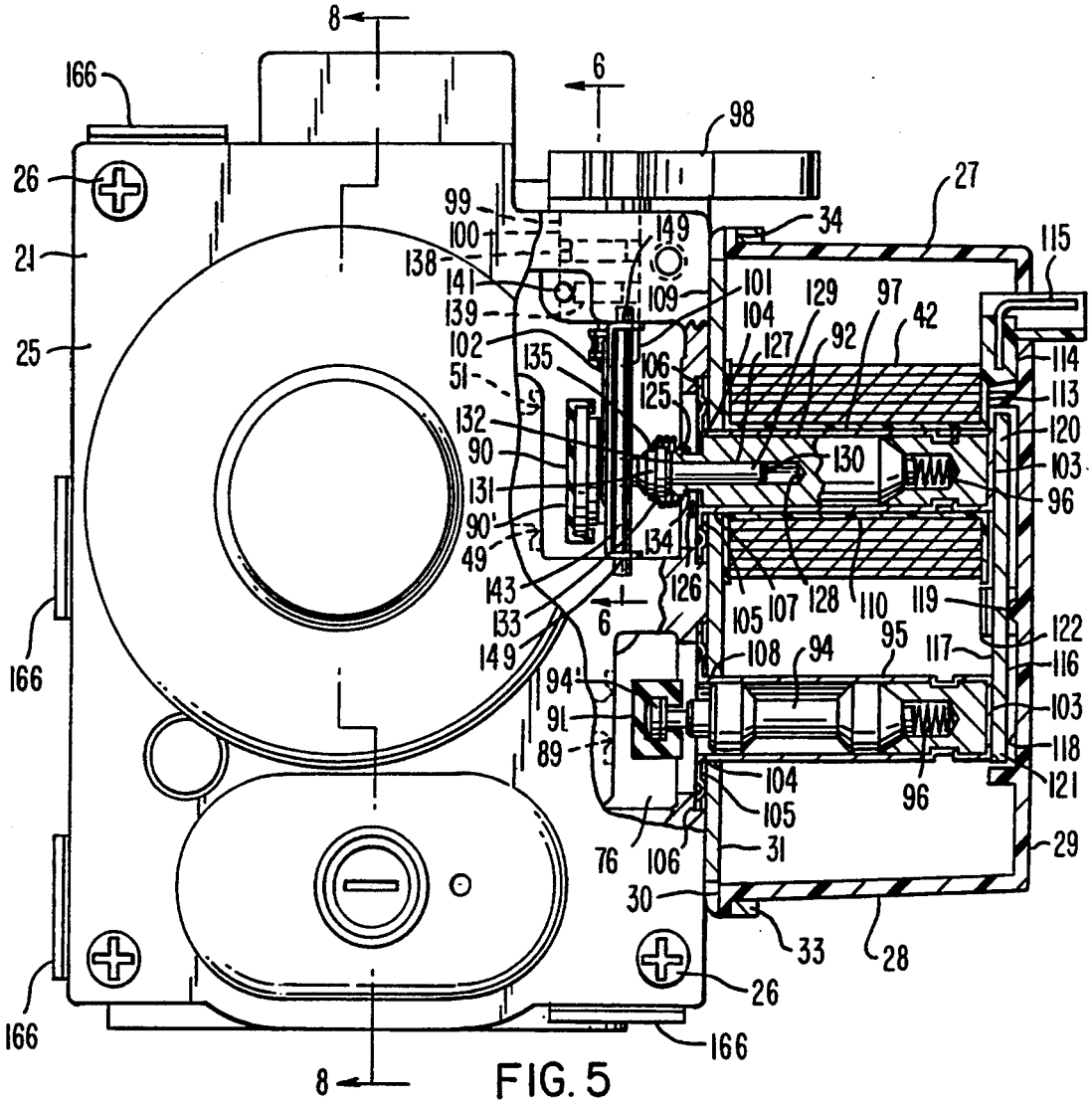
FIG. 5 is a view similar to FIG. 3 and illustrates both of the valve members that are controlled by the coil arrangement being disposed in the open position thereof by the coil means being energized.

A manually operated "on off" actuator 98 is rotatably carried by the housing means 21 as the same has a shaft portion 99 rotatably disposed in an opening 100 of the housing means 21 and is provided with a cam means 101 which is adapted to cause the valve member 90 to be held in a closed condition against the valve seat 49 by a pivotally mounted arm means 102 in a manner hereinafter set forth when the actuator 98 is set in its "off" position as illustrated in FIG. 4 even if the coil means 42 should be energized. However, when the actuator 98 is disposed in its "on" condition as illustrated in FIGS. 3 and 5, the coil 42 is adapted to move the valve member 90 to its open position relative to the valve seat 49 when the coil means 42 is energized as the cam means 101 permits the arm means 102 to move to a non-restricting position thereof as will be apparent hereinafter.

From the above, it can be seen that the fuel control device 20 of this invention is adapted to operate as follows.

With the actuator 98 disposed in its "on" position and with the coil means 42 being in its deenergized condition, the valve members 90 and 91 are disposed in their closed condition against the valve seats 49 and 89 and the valve member 58 is disposed against its valve seat 50 by the force of the compression spring 83. At this time, the valve member 61 is being held in its fully open position relative to the valve seat 59 by the force of the spring 65 as the chamber 64 and the outlet 36 is at atmospheric pressure.

However, when the circuit means 43 determines that the burner means 39 should be fed fuel so as to heat the water in the tank of the water heater 46, the circuit means 43 energizes the coil means 42 which substantially simultaneously opens the valve members 90 and 91 away from the valve seats 49 and 89 whereby the fuel now flowing into the passage 51 through the open valve seat 49 acts against the side 54 of the diaphragm section 57 to tend to open the valve member 58 away from the valve seat in opposition to the force of the compression spring 83. However, the fluid that is trapped in the chamber 80 and, by the passage means 81, in the chamber 76 resists such opening movement and the same must begin to be exhausted through the now opened valve seat 89 and passage 87 to the chamber 86 and opened valve seat 59 to the chamber 64 and out through the passage 79 to the outlet 36. However, the slow opener 82 in the passage 81 restricts the flow of fluid out of the chamber 80 so that the valve member 58 slowly opens relative to the valve seat 50 and interconnects the inlet 35 to the outlet 36 so that fuel can now issue from the burner means 39 and be ignited by the circuit means 43 all in a manner well known in the art whereby as long as the coil means 42 remains energized, fuel is adapted to flow to the burner means 39 to heat the water in the water heater 46, the valve member 61 controlling the amount of opening of the valve member 58 relative to the valve seat 50 as the same is responsive to the pressure of the fuel in the outlet 36 which acts against the side 54 of the diaphragm section 62 to tend to close the valve member 61 relative to the valve seat 59 and, thus, control the pressure of the fluid in the chamber 80 of the main valve member 58 all in a manner and for reasons well known in the art.

When the circuit means 43 determines that the burner means 39 should be turned off as the temperature of the water in the water heater 46 is approximately at the selected temperature thereof, the circuit means 43 disconnects the electrical power source 41 from the coil means 42 so that the deenergized coil means 42 permits the spring means 96 for the plunger means 92 and 94 to respectively move the valve members 90 and 91 against the respective valve seats 49 and 89 to terminate the flow of fuel from the inlet 35 to the outlet 36, the passage means 75 and 81 causing the diaphragm section 57 to subsequently close the valve member 58 against the valve seat 50 under the force of the compression spring 83 as the orifice means 77 permits the fluid to be eventually balanced on the opposite sides 54 and 67 of the diaphragm section 57 in a manner well known in the art whereby the fuel control device 20 remains in the "off" condition illustrated in FIG. 12 until the circuit means 43 again determines that fuel should be directed to the burner means 39 in the manner previously set forth.

However, as previously stated, should the actuator 98 be disposed in the "off" position thereof, the cam 101 operates on the arm means 102 to positively hold the valve member 90 against the valve seat 49 in a manner hereinafter set forth even though the circuit means 43 energizes the coil 42 so that no fuel can flow to the burner means 39 as long as the actuator 98 is disposed in the "off" condition thereof.

As previously stated, the fuel control device 20 of this invention has unique means to permit the same to operate in the manner previously described and, therefore, the details of such features of this invention will now be described with the understanding that even though all of the features of this invention are provided in the fuel control device 20, each feature could be provided in a fuel control device without any of the other features, if desired.

The pole pieces 95 and 97 respectively for the armatures or plungers 94 and 92 comprise tubular members formed of metallic material and respectively having a closed end 103 and an open end 104, each open end 104 having an integral washer-like annular structure 105 extending radially outwardly therefrom and being received in a recess 106 formed in the exterior wall means 22 of the housing means 21 as illustrated in FIGS. 3 and 4 as the tubular pole pieces 95 and 97 respectively extend through openings 107 and 108 formed through the flux plate 31 in spaced apart relation whereby the washer-like parts 105 are sandwiched between the wall means 22 of the housing means 21 and a facing side 109 of the flux plate 31.

A bobbin 110 formed of any suitable electrically insulating material has the coil means 42 wound about the same and is disposed over the tubular pole piece 97 so as to position the coil means 42 of electrical wire about the pole piece 97, the bobbin 110 having a disc-shaped end 111 disposed against a side 112 of the flux plate 31 and another disc-shaped end 113 having an enlargement 114 at the outer end thereof that carries terminal means 115 for respectively interconnecting the power source 41 to the coil means 42 by the circuit means 43 previously described.

Figure 9:
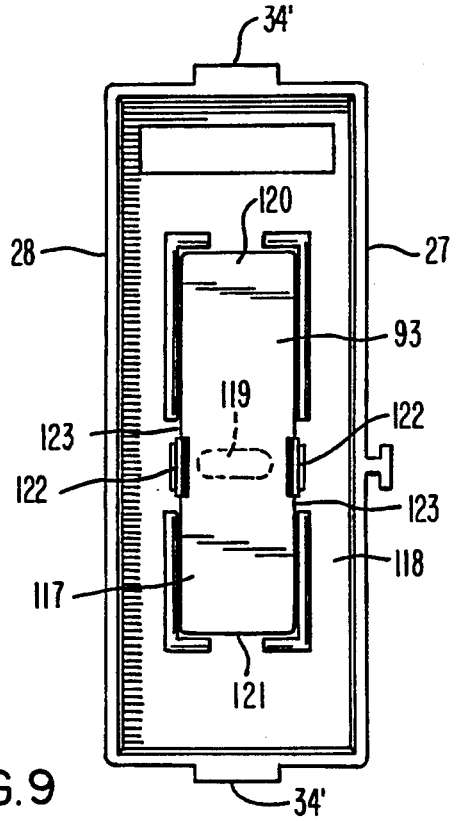
FIG. 9 is a view looking into the cup-shaped casing for the control device of FIGS. 1–8 and illustrating one of the flux plates mounted therein.

The other flux plate 93 has opposed flat sides 116 and 117 and is disposed adjacent an inside surface 118 of the closed end 29 of the cup-shaped casing 27, the flux plate 93 being held against an inwardly directed ridge means 119 by the ends 103 of the pole pieces 95 and 97 respectively engaging the side 117 of the flux plate 93 at opposite end portions 120 and 121 thereof to tend to bow the flux plate 93 on the ridge means 119 and thereby assist in holding the pole members 95 and 97 in fixed aligned parallel relation between the flux plates 31 and 93 when the casing 27 is snap-fit to the flux plate 31 as previously described. In order to initially hold the flux plate 93 in position in the casing 27, the casing 27 has integral bracket pieces 122, FIG. 9, that extend over opposed side edge means 123 of the flux plate 93 when the same is disposed in the position illustrated in FIG. 9 and originally located in the casing 27 by other ridge means 124 that extend inwardly from the side 118 of the casing 27 as illustrated.

The plunger 92 has an end 125 provided with an annular recess 126 and being interrupted by an opening 127 that extends to a closed end 128 thereof.

The valve member 90 has a valve stem 129 extending therefrom and being received in the opening 127 of the plunger 92, the valve stem 129 having an end 130 and an enlargement 131 intermediate the end 130 thereof and the valve member 90 as illustrated. The enlargement 131 defines an annular shoulder 132 that is adapted to abut the end 125 of the plunger 92 as illustrated in FIG. 5 and in such engagement condition, the end 130 of the stem 129 is spaced from the end 128 of the opening 127 in the plunger 92.

In order to tend to hold the annular shoulder 132 of the enlargement 131 of the valve stem 129 against the end 125 of the plunger 92, a coiled tension spring 133 has one end 134 interconnected to the plunger 92 by being telescoped over the end 125 thereof and being received in the annular recess 126 thereof and has another end 135 thereof telescopically disposed over the enlargement 133 of the valve stem 129 so that the natural resiliency of the tension spring 133 holds the shoulder 132 of the enlargement 131 of the valve stem 129 in engagement with the end 125 of the plunger 92 so that the valve member 90 normally follows the movement of the plunger 92 relative to the valve seat 49.

However, when the arm 102 of the actuator 98 holds the valve member 90 against the valve seat 49 as previously set forth, the armature or plunger 92 can be drawn upwardly into the pole piece 97 by the energized coil 42 in opposition to the force of the compression spring 96 and the tension spring 133 will be extended in the manner illustrated in FIG. 4 to permit such movement of the plunger 92 while the arm 102 is holding the valve member 90 against the valve seat 49 as illustrated in FIG. 4.

Thus, it can be seen that the tension spring 133 is uniquely utilized to permit the plunger 92 to move relative to the valve stem 129 of the valve member 90 when required. However, the tension spring 133 permits the valve stem 129 to move in unison with the plunger 92 when the arm 102 is in its non-restrictive position as the actuator 98 is in the "on" position thereof.

The shaft 99 of the actuator 98 is substantially cylindrical and has opposed ends 136 and 137 with a pair of annular grooves 138 and 139 disposed in spaced apart relation intermediate the ends 136 and 137 thereof. An annular O-ring sealing member 140 is disposed in the groove 138 to seal the opening 100 so that no fuel from the chamber 47 can reach the exterior of the housing means 21 through the opening 100. A pin or rod 141 is carried by the housing means 21 and is received in a cross manner in the annular groove 139 so as to prevent the shaft 99 from being pulled from the housing means 21 or pushed inwardly relative to the housing means 21 while still permitting rotation of the shaft 99 relative to the housing means 21.

Figure 7:
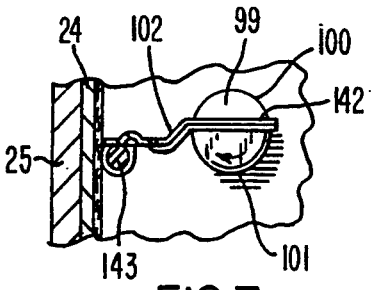
FIG. 7 is a fragmentary cross-sectional view taken on line 7—7 of FIG. 6.

The shaft 99 of the actuator 98 has the cam 101 integral and one-piece therewith and comprising a substantially semi-circular part as illustrated in FIG. 7 which is adapted to operate on a leg 142 of the arm 102 that is pivotally mounted to the housing means 21 by a pivot pin 143 having its opposed ends 144 and 145 respectively disposed in recesses 146 and 147 formed in the housing means 21 on opposite sides of the chamber 47 as illustrated. In particular, the arm 102 has an end 148 provided with ears 149 having openings (not shown) therethrough and receiving the pivot shaft 143 therethrough so that the arm 102 can pivot at the end 148 thereof relative to the housing means 21.

Figure 6:
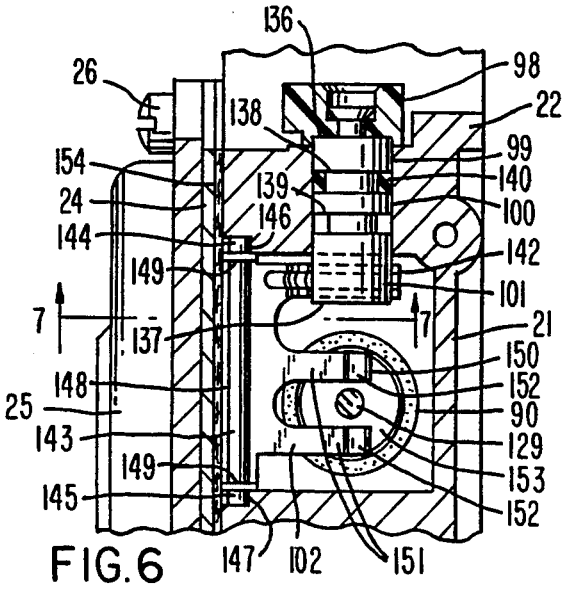
FIG. 6 is a fragmentary cross-sectional view taken on line 6—6 of FIG. 5.

The other end 150 of the arm 102 comprises a pair of legs 151 that are disposed in spaced apart parallel relation and respectively have ends 152 bearing against a side 153 of the valve member 90 while straddling the valve stem 129 as illustrated in FIG. 6.

Thus, when the actuator 98 is rotated to its "off" position, the cam 101 of the actuator 98 acts on the leg 142 to pivot the arm 102 in a direction that moves the legs 151 so as to hold the valve member 90 in its closed condition against the valve seat 49 as illustrated in FIG. 4 but when the actuator 98 is rotated to its "on" position, the cam 101 is positioned out of the way so that the leg 142 will not be restricted in the pivoting movement of the arm 102 following the movement of the valve member 90 being pulled by the armature 92 toward the coil means 42 when the coil means 42 is energized as illustrated in FIG. 5.

Therefore, it can be seen that the actuator 98 through the arm 102 can positively hold the valve member 90 in its closed condition while the tension spring 133 uniquely permits the armature 92 to move relative to the valve member 90 when the valve member 90 is held in its closed condition by the arm 102. In contrast, the tension spring 133 causes the valve member 90 to move in unison with the plunger 92 when the actuator 98 is disposed in its "on" position.

A suitable polymeric member 90' covers the valve member 90 so as to resiliently engage against the valve seat 49 as illustrated. Of course, the valve member 90 could be coated with resilient material, if desired, for the same purpose.

Similarly, the valve member 91 comprises a resilient polymeric member that is carried on an enlarged end 94' of the armature 94 as illustrated so as to sealingly cooperate with the valve seat 89 as is well known in the art.

As best illustrated in FIG. 8, it can be seen that the unique valve plate 24 of this invention comprises a one-piece metallic member and that the main valve seat 50 is formed in the side 53 thereof in a manner to surround the opening 70 thereof. Similarly, the valve seat 59 is formed in the other side 60 of the one-piece valve plate 24 to cooperate with the opening 71 passing therethrough.

The valve plate 24 is disposed in stacked relation against a sealing gasket means 154 that cooperates with a side 155 of the housing body 23 as illustrated in FIG. 8.

The diaphragm means 55 of this invention also comprises a one-piece homogeneous member formed of any suitable polymeric material and arranged to be disposed against the side 53 of the valve plate 24 and be held there-against by the housing cover or member 25 in the manner previously described.

Figure 10:
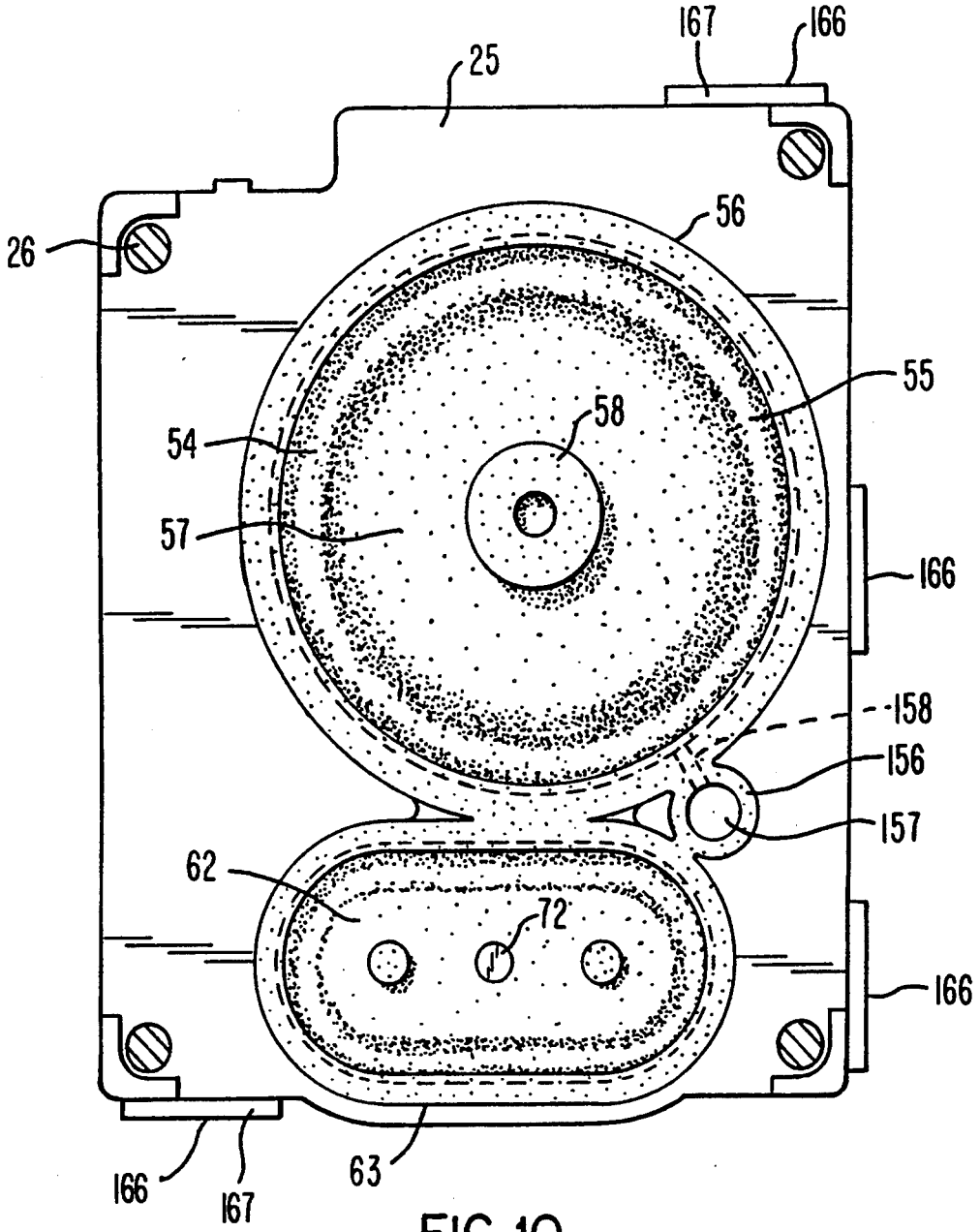
FIG. 10 is a cross-sectional view taken on line 10—10 of FIG. 8 so as to illustrate the one-piece diaphragm means of this invention.

It can readily be seen in FIG. 10 how the diaphragm means 55 is shaped in the one-piece construction thereof to form the two diaphragm sections 57 and 62 and have an annular part 156 providing a cavity 157 that is interconnected to the chamber 80 that is formed between the diaphragm section 57 and the cover 25 by a passage means 158 formed in the side 67 of the diaphragm means 55 so that the chamber 157 of the diaphragm means 55 will be aligned with an opening 159 in the valve plate 24 to lead to the chamber 76 that is controlled by the valve member 91 by the internal passage means 81 previously described and schematically illustrated in FIG. 12.

The main valve member 58 is an integral part of the diaphragm means 55 and cooperates with a diaphragm back-up plate 160 as illustrated in FIG. 8. In contrast, the valve member 61 and its integral valve stem 72 is a part that is separate from the diaphragm means 55 and is formed of metallic material and is interconnected to an enlarged part 161 thereof by being disposed therein in a snap-fit interconnecting manner as is well known in the art, the diaphragm section 62 also having a backup diaphragm plate means 162 against which the compression spring 65 has the end 66 thereof engaging for the reasons previously set forth.

As illustrated in FIG. 8, the main valve portion 58 of the diaphragm section 57 has an enlargement 163 on the side 67 thereof which defines an annular groove 164 therein to receive the telescoped end 84 of the compression spring 83 therein as illustrated, the internal peripheral edge means 165 of the backup plate 160 likewise being telescopically received in the annular groove 164 and having the end 84 of the spring 83 engaging the same as illustrated.

Thus, it can be seen that the one-piece valve plate 24 and the one-piece diaphragm means 55 cooperate together with the cover member 25 of the housing means 21 to provide a unique arrangement wherein the valve members 58 and 61 operate on opposite sides of the valve plate 24 to control the respective valve seats 50 and 59 for the reasons and in the manner previously set forth.

As previously set forth, the electrical circuit means 43 illustrated schematically in FIG. 12 can be disposed in the housing means 44 which, in turn, can be secured to the housing means 21 of the fuel control device 20 in any suitable manner so as to be carried thereby.

Figure 15:
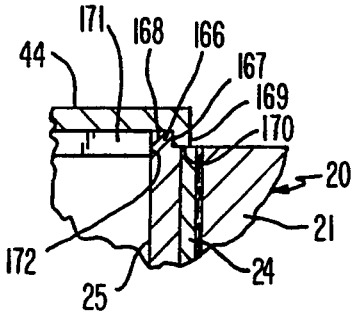
FIG. 15 is an enlarged fragmentary cross-sectional view taken on line 15—15 and illustrates how the electronic control system housing means is snap-fitted to the housing means of the fuel control device of FIGS. 1–12.

In particular, one working embodiment of the fuel control device 20 of this invention has a plurality of outwardly directed flanges 166 formed on the housing member 25 and each being provided with a substantially straight or flat ledge 167 and a camming surface 168 as illustrated in FIG. 8. The housing member 44 for the electronic circuit means 43 has tabs 169 formed thereon and cooperating with the flanges 166 so as to have the edges 170 of the respective tabs 169 cam outwardly by the cam surfaces 168 to snap over the flanges 166 against the sides 167 thereof as illustrated in FIG. 15 while other portions 171 of the housing means 44 have surface means 172 engaging against the cover member 25 as illustrated in FIG. 15 to prevent the housing means 44 from being removed from the housing means 21 once the tabs 169 have been snap-fit in place as illustrated in FIG. 15. However, it is to be understood that the housing means 44 could be secured to the housing means 21 in any desired manner.

It is also to be understood that the fuel control device 20 of this invention can be utilized without having the housing means 44 being provided therefor as the electrical circuit means 43 can be provided by means other than a housing means 44, as desired.

Therefore, it can be seen that this invention not only provides a new fuel control device but also this invention provides a new method of making such a fuel control device.

While the forms and methods of this invention now preferred have been illustrated and described as required by the Patent Statute, it is to be understood that other forms and method steps can be utilized and still fall within the scope of the appended claims wherein each claim sets forth what is believed to be known in each claim prior to this invention in the portion of each claim that is disposed before the terms "the improvement" and sets forth what is believed to be new in each claim according to this invention in the portion of each claim that is disposed after the terms "the improvement" whereby it is believed that each claim sets forth a novel, useful and unobvious invention within the purview of the Patent Statute.

What is claimed is:

1. In a fuel control device comprising a housing means having an inlet separated from an outlet by a valve seat, a movable valve member carried by said housing means for opening and closing said valve seat, an electrical coil carried by said housing means, a movable armature carried by said housing means and being movable to a first position thereof by said coil being energized and being movable to a second position thereof when said coil is deenergized, and means operatively interconnecting said valve member to said armature so that said valve member tends to move to an open position thereof relative to said valve seat when said armature is moved to said first position thereof and tends to move to a closed position thereof with said valve seat when said armature is moved to said second position thereof, said means operatively interconnecting said valve member to said armature comprising a tension spring, the improvement comprising a movable actuator carried by said housing means and having an "off" position and an "on" position, said actuator being operatively interconnected to said valve member and having means for holding said valve member in said closed position thereof when said actuator is in said "off" position thereof even if said coil is subsequently energized and for permitting said valve member to move to said open position thereof when said actuator is in said "on" position thereof.

2. A control device as set forth in claim 1 wherein said means of said actuator comprises a rotatable cam.

3. A control device as set forth in claim 2 wherein said means of said actuator comprises an arm means pivotally mounted to said housing means and having a first portion thereof that is engageable with said valve member and a second portion thereof that is engageable with said cam, said cam when disposed in engagement with said second portion thereof holds said arm means in such a pivoted position thereof that said first portion thereof is in engagement with said valve member and holds said valve member in said closed position thereof.

4. A control device as set forth in claim 3 wherein said arm means has three legs extending therefrom, two of said legs comprising said first portion thereof and the other of said legs comprising said second portion thereof.

5. A control device as set forth in claim 1 wherein said valve member has a stem means extending therefrom, said tension spring being a coiled member having opposed coiled ends respectively telescoped onto said armature and onto said stem means to operatively interconnect said armature to said valve member.

6. A control device as set forth in claim 5 wherein said armature has an opening means therein, said stem means of said valve member extending into said opening means in said positions of said valve member.

7. A control device as set forth in claim 6 wherein said coil has an opening therein, said armature comprising a plunger having opposed ends thereof one of which is disposed in said opening of said coil in said positions of said armature and the other of which has said opening means therein.

8. A control device as set forth in claim 1 wherein said housing means has another inlet separated from another outlet by another valve seat, and another movable valve member carried by said housing means for opening and closing said other valve seat, said other valve member having another armature controlled by said coil and being movable to a first position thereof by said coil being energized and being movable to a second position thereof when said coil is deenergized, said other armature moving said other valve member to an open position relative to said other valve seat when said other armature moves to said first position thereof and moving said other valve member to a closed position with said other valve seat when said other armature moves to said second position thereof.

* * * * *